US009371814B2

(12) United States Patent
Eisen et al.

(10) Patent No.: US 9,371,814 B2
(45) Date of Patent: Jun. 21, 2016

(54) IGNITION DEVICE FOR AN INTERNAL COMBUSTION ENGINE AND METHOD FOR OPERATING AN IGNITION DEVICE FOR AN INTERNAL COMBUSTION ENGINE

(75) Inventors: Sven-Michael Eisen, Regensburg (DE); Stephan Bolz, Pfatter (DE); Harald Schmauβ, Donaustauf (DE); Achim Reuther, Donaustauf (DE); Martin Götzenberger, Ingolstadt (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 350 days.

(21) Appl. No.: 13/988,864

(22) PCT Filed: Nov. 17, 2011

(86) PCT No.: PCT/EP2011/070368

§ 371 (c)(1),
(2), (4) Date: Jun. 22, 2013

(87) PCT Pub. No.: WO2012/069358

PCT Pub. Date: May 31, 2012

(65) Prior Publication Data

US 2013/0263835 A1 Oct. 10, 2013

(30) Foreign Application Priority Data

Nov. 23, 2010 (DE) ..... 10 2010 061 791
Nov. 26, 2010 (DE) ..... 10 2010 062 063

(51) Int. Cl.
*F02P 15/08* (2006.01)
*F02P 1/00* (2006.01)

(Continued)

(52) U.S. Cl.
CPC ..... *F02P 1/00* (2013.01); *F02P 3/0435* (2013.01); *F02P 9/007* (2013.01); *F02P 15/10* (2013.01)

(58) Field of Classification Search
CPC ..... F02P 1/00; F02P 1/08; F02P 9/007; F02P 3/04; F02P 3/0435; F02P 15/08
USPC ..... 123/605, 618, 621, 623, 636, 650; 361/247, 263
See application file for complete search history.

(56) References Cited

U.S. PATENT DOCUMENTS 5,886,476 A 3/1999 Skinner et al. ..... 315/209 T
5,947,093 A * 9/1999 Ward ..... 123/598

(Continued)

FOREIGN PATENT DOCUMENTS

DE 3822794 A1 1/1990 ..... F02P 15/08
DE 102009057925 A1 6/2011 ..... F02P 3/05

(Continued)

OTHER PUBLICATIONS

International Search Report and Written Opinion, Application No. PCT/EP2011/070368, 13 pages, Jul. 16, 2012.

*Primary Examiner* — Hai Huynh
(74) *Attorney, Agent, or Firm* — Slayden Grubert Beard PLLC

(57) ABSTRACT

An ignition device for an internal combustion engine includes an ignition coil designed as a transformer, the secondary winding thereof being designed to connect to a spark plug, an actuatable switch element connected in series with the primary winding of the ignition coil, and a controller connected to the primary winding of the ignition coil and the control input of the switching element. The controller has a voltage converter which provides a supply voltage for the ignition coil at the output thereof and which can be connected to a motor vehicle electrical system voltage, a controllable changeover switch for applying the supply voltage at either positive or negative polarity to the series circuit of the primary winding of the ignition coil and the switching element, depending on a control signal, and a control circuit which generates the control signal based on a phase of the ignition process.

6 Claims, 4 Drawing Sheets

(51) Int. Cl.

| | |
|---|---|
| ***F02P 3/04*** | (2006.01) |
| ***F02P 9/00*** | (2006.01) |
| ***F02P 15/10*** | (2006.01) |

(56) References Cited

U.S. PATENT DOCUMENTS

| | | | | |
|---|---|---|---|---|
| 6,142,130 | A * | 11/2000 | Ward | 123/606 |
| 6,189,522 | B1 | 2/2001 | Moriya | 123/643 |
| 6,305,365 | B1 * | 10/2001 | Maeoka et al. | 123/604 |
| 6,425,383 | B1 | 7/2002 | Raeske et al. | 123/643 |
| 6,584,965 | B1 * | 7/2003 | Ward | 123/605 |
| 6,679,237 | B1 * | 1/2004 | Skinner et al. | 123/643 |
| 6,823,841 | B2 * | 11/2004 | Schmolla | 123/406.12 |
| 7,392,798 | B2 * | 7/2008 | Wada et al. | 123/620 |
| 8,985,090 | B2 * | 3/2015 | Bolz et al. | 123/623 |
| 2008/0121214 | A1 * | 5/2008 | Bertsch et al. | 123/406.12 |
| 2012/0312285 | A1 | 12/2012 | Bolz et al. | 123/623 |
| 2013/0263835 | A1 | 10/2013 | Eisen et al. | 123/623 |

FOREIGN PATENT DOCUMENTS

| | | | | |
|---|---|---|---|---|
| EP | 2141352 | A1 | 1/2010 | F02P 15/10 |
| WO | 2012/069358 | A2 | 5/2012 | |

* cited by examiner

IGNITION DEVICE FOR AN INTERNAL COMBUSTION ENGINE AND METHOD FOR OPERATING AN IGNITION DEVICE FOR AN INTERNAL COMBUSTION ENGINE

CROSS-REFERENCE TO RELATED APPLICATIONS

This application is a U.S. National Stage Application of International Application No. PCT/EP2011/070368 filed Nov. 17, 2011, which designates the United States of America, and claims priority to DE Application No. 10 2010 061 791.1 filed Nov. 23, 2010 and DE Application No. 10 2010 062 063.7 filed Nov. 26, 2010, the contents of which are hereby incorporated by reference in their entirety.

TECHNICAL FIELD

This disclosure relates to ignition systems and devices, e.g., for use with an internal combustion engine.

BACKGROUND

Series ignition systems in contemporary internal combustion engines which are embodied as spark ignition engines have been operating for many decades according to the simple and reliable principle of coil discharge, i.e. an ignition coil which is configured as a transformer is charged partially as far as its saturation range on the primary side in accordance with its inductance from the on-board power system voltage. At the ignition time, the charge is interrupted by means of an electronic switching operation, for example by an ignition IGBT (Insulated Gate Bipolar Transistor). As a result, a voltage of, for example, 5 kV to 35 kV is built up on the secondary side and gives rise to a flashover in the spark gap of the spark plug in the combustion chamber of the internal combustion engine. The energy which is stored in the coil is subsequently dissipated in the ignition plasma.

In the course of the progressive development of engines, it has been necessary to implement reductions in terms of consumption and emissions, and in the last few years these have consequently placed an increasing additional burden on the ignition system and will continue to do so in the future. Examples of this are, for example, stratified combustion in which liquid fuel components with high flow rates impede the spark discharge and bring about numerous new spark formations. Rising combustion chamber pressures for improving the engine efficiency also increase the breakdown resistance in the spark gap and bring about an increase in the breakdown voltage which also influences the spark plug wear. In future highly charged engine generations the latter will give rise to secondary-side voltage increases far beyond 35 kV. Both the rising breakdown voltages and the flow states which become more intensive at the spark plug have a tendency to shorten the duration of the spark since ever larger proportions of the energy stored in the coil have to be made available to build up and maintain the spark. A most promising trend in the development of new combustion methods is the use of multiple sparks, wherein the coil energy is transmitted efficiently to the mixture at short intervals, which increases the inflammation reliability.

In application DE 10 2009 057 925.7, which was not published before the priority date of the present document, an innovative method for operating an ignition device for an internal combustion engine and an innovative ignition device for an internal combustion engine for carrying out the method are described. Accordingly, an ignition device for an internal combustion engine is formed with an ignition coil which is embodied as a transformer, a spark plug which is connected to the secondary winding of the ignition coil, a controllable switching element which is connected in series with the primary winding of the ignition coil, and a control unit which is connected to the primary winding of the ignition coil and to the control input of the switching element. The control unit makes available an adjustable supply voltage for the ignition coil and a control signal for the switching element as a function of the currents through the primary winding and the secondary winding of the ignition coil and as a function of the voltage between the connecting point of the primary winding of the ignition coil to the switching element and the negative terminal of the supply voltage. The method for operating this device has the following sequence in this context:

In a first phase (charging), the switching element is switched on by the control signal at a first switch-on time and switched off again at the predefined ignition time, in a subsequent second phase (breakdown), the primary voltage or a voltage derived therefrom is compared with a first threshold value, and when this voltage undershoots the first threshold value the switching element is switched on again at a second switch-on time, in a subsequent third phase (arc) the supply voltage is regulated in such a way that the current through the secondary winding of the ignition coil corresponds approximately to a predefined current, and the current through the primary winding of the ignition coil is compared with a predefined second threshold value, and when this current overshoots the second threshold value the switching element is switched off again at a first switch-off time, in a subsequent fourth phase (breakdown), the current through the secondary winding of the ignition coil is compared with a third threshold value, and when this current undershoots the third threshold value the switching element is switched on again at a third switch-on time, the third and the fourth phase are, if appropriate, subsequently repeated until a predefined spark duration is reached at a time at which the switching element is definitively switched off.

A corresponding device is illustrated in FIG. 1, and the time profile of the significant voltages and currents is illustrated in FIG. 2.

However, a problem even with ignition devices of this type is the high breakdown voltage which is required for the first ignition in highly charged engines. It is known in this context that the breakdown voltage is lower in the case of negative polarity, that is to say if the positive potential of the supply voltage is applied to the ignition hook of the spark plug. On the other hand, under certain circumstances the inflammation of the mixture in the combustion chamber can be improved given a positive polarity.

SUMMARY

One embodiment provides an ignition device for an internal combustion engine which is formed with an ignition coil which is embodied as a transformer and whose secondary winding is designed to connect to a spark plug, a controllable switching element which is connected in series with the primary winding of the ignition coil, and a control unit which is connected to the primary winding of the ignition coil and to the control input of the switching element, wherein the control unit is formed with a voltage converter which makes available, at its output, a supply voltage for the ignition coil and can be connected to a motor vehicle on-board power system voltage, with a controllable changeover switch via which the supply voltage can be applied with either a positive or negative polarity to the series circuit composed of the primary winding of the ignition coil and the switching element, as a function of a control signal, and with a control circuit which generates the control signal as a function of the phase of the ignition process.

Another embodiment provides an ignition device for an internal combustion engine which is formed with an ignition coil which is embodied as a transformer and whose secondary winding is designed to connect to a spark plug, with a first controllable switching element which connects a first terminal of the primary winding of the ignition coil to a reference potential, and with a second controllable switching element which connects a second terminal of the primary winding of the ignition coil to the reference potential, with a controllable changeover switch via which a supply voltage can be applied to either the first terminal or the second terminal of the primary winding of the ignition coil as a function of control signals, and with a control unit which is connected to the control inputs of the first and of the second switching element and to the changeover switch and which can be connected to a motor vehicle on-board power system voltage and makes available, at a first output, the supply voltage for the ignition coil and which generates the control signals for the controllable switching elements and the changeover switch as a function of the phase of an ignition process.

Another embodiment provides an ignition device for an internal combustion engine which is formed with an ignition coil which is embodied as a transformer and whose secondary winding is designed to connect to a spark plug, with a first controllable switching element which connects a first terminal of the primary winding of the ignition coil to a reference potential, and with a second controllable switching element which connects a second terminal of the primary winding of the ignition coil to the reference potential, with a center tap of the primary winding of the ignition coil to which a supply voltage can be applied, and with a control unit which is connected to the control inputs of the first and of the second switching element and which can be connected to a motor vehicle on-board power system voltage and makes available, at a first output, the supply voltage for the ignition coil, and which generates the control signals for the controllable switching elements as a function of the phase of an ignition process.

In a further embodiment, the first controllable switching element and the second controllable switching element and the changeover switch are formed with transistors which contain inverse diodes, and in which diodes are arranged in series with the first switching element and the second switching element and/or the transistors of the changeover switch, with polarity such that in the case of an interruption in the energy supply to the primary winding of the ignition coil no current can flow through the primary winding.

Another embodiment provides a method for operating an ignition device for an internal combustion engine which is formed with an ignition coil which is embodied as a transformer, a spark plug which is connected to the secondary winding of the ignition coil, a controllable switching element which is connected in series with the primary winding of the ignition coil, and a control unit which is connected to the primary winding of the ignition coil and to the control input of the switching element, wherein the control unit makes available a supply voltage for the ignition coil, which voltage is applied either with a positive or negative polarity to the series circuit composed of the primary winding of the ignition coil and the switching element as a function of a control signal, wherein the control signal is generated as a function of the phase of the ignition process.

In a further embodiment, at the start of an ignition process the supply voltage is firstly applied with a negative polarity, and the polarity is reversed after the breakdown voltage is reached.

BRIEF DESCRIPTION OF THE DRAWINGS

Exemplary embodiments will be explained in more detail below based on the schematic drawings, wherein.

DETAILED DESCRIPTION

Figure 1:
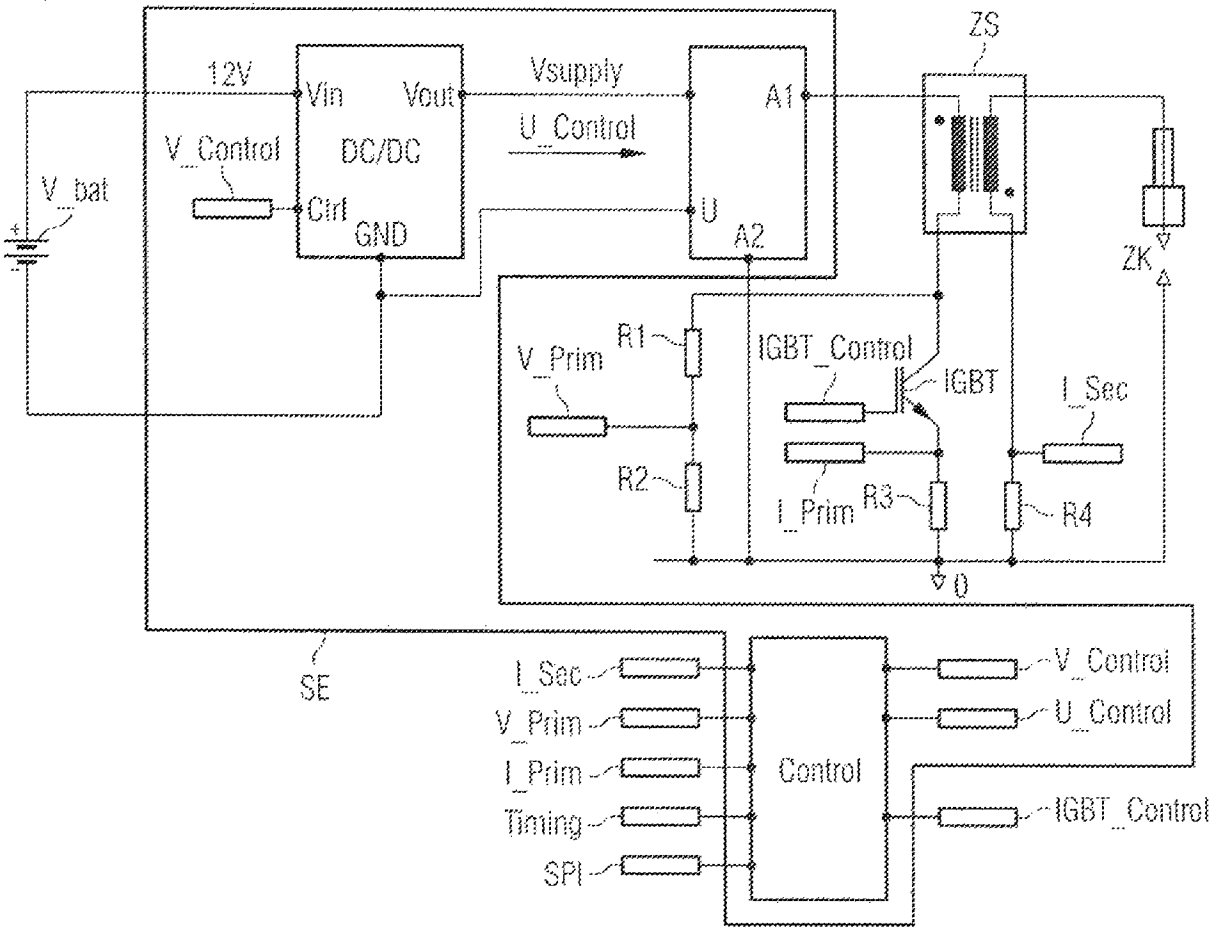
FIG. 1 shows a block circuit diagram of an ignition device according to one embodiment.
Figure 2:
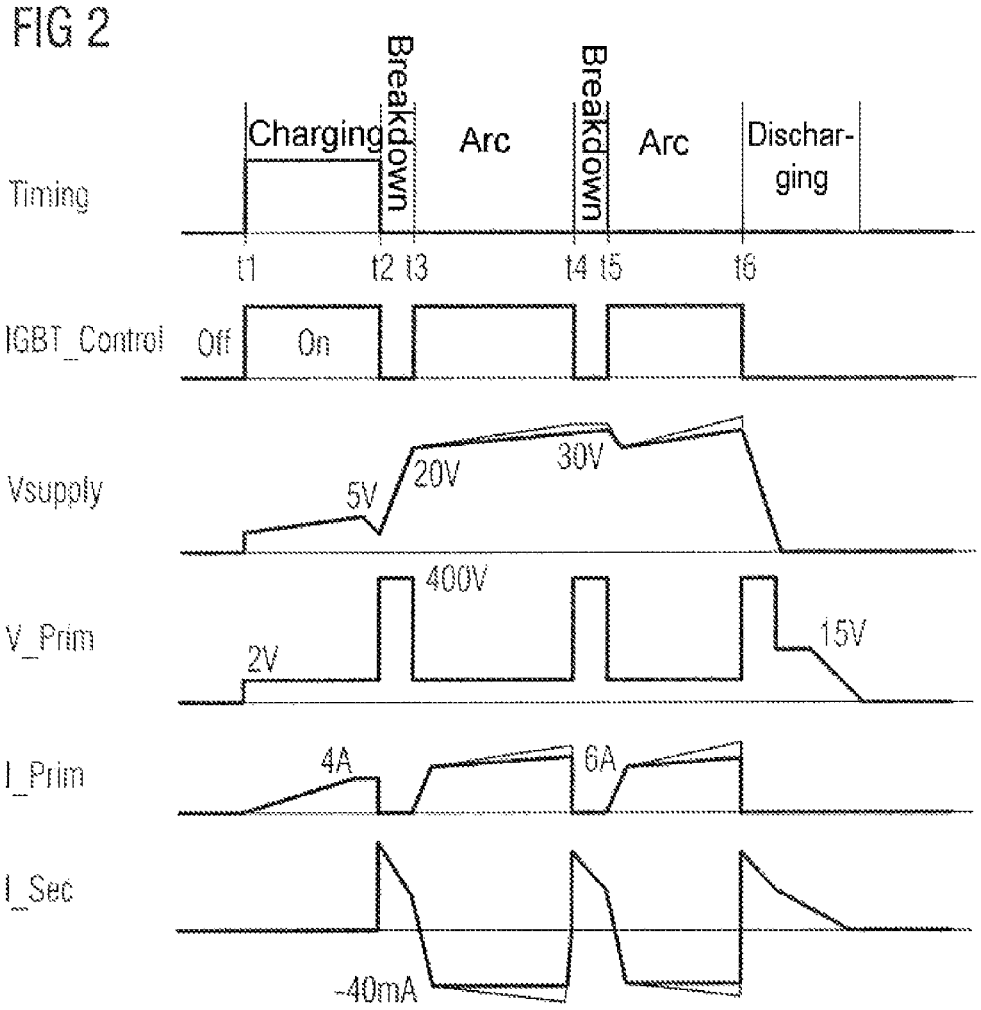
FIG. 2 shows a flowchart which clarifies the chronological relationships in conjunction with the threshold values.

Embodiments of the present disclosure provide an optimized supply of energy.

For example, some embodiments provide an ignition device for an internal combustion engine which is formed with an ignition coil which is embodied as a transformer and whose secondary winding is designed to connect to a spark plug, a controllable switching element which is connected in series with the primary winding of the ignition coil, and a control unit which is connected to the primary winding of the ignition coil and to the control input of the switching element. The control unit is formed in this case with a voltage converter which makes available, at its output, a supply voltage for the ignition coil and can be connected to a motor vehicle on-board power system voltage, with a controllable changeover switch via which the supply voltage can be applied with either a positive or negative polarity to the series circuit composed of the primary winding of the ignition coil and the switching element (IGBT), as a function of a control signal, and with a control circuit which generates the control signal as a function of the phase of the ignition process.

Other embodiments provide an ignition device formed with an ignition coil which is embodied as a transformer and whose secondary winding is designed to connect to a spark plug, with a first controllable switching element which connects a first terminal of the primary winding of the ignition coil to a reference potential, and with a second controllable switching element which connects a second terminal of the primary winding of the ignition coil to the reference potential, with a controllable changeover switch via which a supply voltage can be applied to either the first terminal or the second terminal of the primary winding of the ignition coil as a function of control signals, and with a control unit which is connected to the control inputs of the first and of the second switching element and to the changeover switch and which can be connected to a motor vehicle on-board power system voltage and makes available, at a first output, the supply voltage for the ignition coil and which generates the control signals for the controllable switching elements and the changeover switch as a function of the phase of an ignition process.

Alternatively, the supply voltage is connected directly, instead of via the controllable changeover switch, to a center tap of the primary winding of the ignition coil.

As a result of these embodiments, the polarity can be implemented electronically as a function of predefined parameters. Rapid electronic switching over of the polarity combines the advantages of reliable mixture inflammation in the stratified engine mode (positive polarity) with the wear-reducing "standard inflammation" in the homogeneous engine mode (negative polarity). After being resolved with respect to cycles, the polarity of the voltage applied to the spark plug can thus be adapted to the requirement of the respective operating state when the engine is running.

In addition, in the case of alternating polarity it is to be expected that the wear on the electrodes will be reduced since the relatively hot, more wear-intensive end of the plasma section acts alternately on the inner and outer electrodes. This effect alone can improve the service life of the spark plug. The possibility of switching over the polarity from one working play to another permits the described advantages of the two ignition variants which were previously used or installed exclusively separately in the engine, i.e. either as a positively poled or else as a negatively poled system.

Other embodiments provide a method for operating the disclosed ignition device for an internal combustion engine.

Various embodiments can therefore make use of both of the above-mentioned advantages by firstly applying the supply voltage with the negative polarity in order to obtain a lower breakthrough voltage and subsequently have the possibility of rotating the polarity in order to achieve a better inflammation capability.

The ignition device according to the embodiment of FIG. 1 comprises a controllable supply voltage source DC/DC which is embodied as a voltage converter and has the purpose of supplying one or more ignition coils ZS with a supply voltage Vsupply which can be varied as appropriate. It is supplied from the on-board power system voltage V_bat of currently approximately 12V. It supplies one or more ignition coils ZS, wherein advantageously no blocking diode is necessary any more. It is possible to use customary spark plugs ZK which are connected to the secondary winding of the ignition coil ZS. The primary winding of the ignition coil ZS is connected in series with a switching element which is usually embodied as an IGBT and has the purpose of switching the ignition coil ZS. Devices are provided for detecting the primary voltage and the primary current and secondary current.

A control unit SE generates the variable supply voltage Vsupply and the control signal IGBT_Control for the switching element IGBT by means of the voltage converter DC/DC as a function of the detected operating variables.

The control unit SE is controlled in turn by a microcontroller (not illustrated) which predefines in real time the ignition time for each ignition coil by means of separate timing inputs. Data can be exchanged between the microcontroller and the control unit SE via a further interface, for example the customary SPI (serial peripheral interface).

The voltage converter DC/DC generates a supply voltage Vsupply from the 12V on-board power system supply V_bat. The value of this supply voltage Vsupply can be controllable in a highly dynamic fashion in a range from, for example, 2 to 30 V by means of the control signal V_Control at the control input Ctrl of the voltage converter DC/DC. The voltage converter DC/DC can in this case supply the required charging current for the respectively activated ignition coil ZS.

The spark plug ZS used can be of customary type with a transmission ratio of, for example, 1:80, but it is possible here to dispense with the blocking diode which is necessary in currently conventional ignition systems. For example, 3 to 8 ignition coils are necessary depending on the number of the cylinders of the spark ignition engine which is used. However, owing to the disclosed method it is possible to use an ignition coil with significantly lower maximum storage energy.

The spark plug ZK used can be of customary type. Its precise embodiment is determined by the use in the engine.

The switching element IGBT used can also be of customary type with an internal voltage limitation of, for example, 400 V. However, depending on the charging current required it is possible to reduce its necessary current carrying capability.

The signal V_Prim maps the primary voltage, stepped down by means of a voltage divider composed of resistors R1 and R2, of the ignition coil ZS of up to 400 V onto a value range of, for example, 5 V which can be used for the control unit SE. The value of the voltage division is 1:80 in the specified example. The voltage divider R1, R2 is arranged between the connecting point of the primary winding of the ignition coil ZS and the switching element IGBT and the ground connection 0.

In order to measure the current through the primary winding of the ignition coil ZS, a resistor R3 is connected in series with the primary winding and the switching element IGBT. The charging current flowing through the resistor R3 generates a voltage I_Prim which represents the current.

In the same way, a resistor R4 is connected in series with the secondary winding of the ignition coil ZS. The secondary current flowing through this resistor R4 generates the voltage I_Sec which drops across the resistor R4.

The control unit SE comprises the voltage converter DC/DC and a control circuit Control. The latter detects the signals V_Prim, I_Prim and I_Sec and compares them with threshold values or set point values V1 . . . V5 by means of voltage comparators.

At a time which is predefined by the input signal Timing of the microcontroller, the control unit SE triggers an ignition process, wherein the spark duration and the arcing current are controlled. For this purpose, the supply voltage Vsupply is controlled by means of the control signal V_Control and the switching element IGBT is switched on and off by means of the control signal IGBT_Control. In the case of spark ignition engines with a plurality of cylinders, a plurality of timing inputs and a plurality of IGBT_Control outputs are to be correspondingly provided.

Furthermore, the control circuit Control is connected to the microcontroller via an SPI interface. As a result, the microcontroller can transmit predefined values for the charging current, spark duration, and spark current, and also even predefined values for the configuration of a multiple spark ignition. The controller can transmit status information and diagnostic information to the microcontroller in the opposite direction.

A changeover switch U is provided in the control unit SE, via which changeover switch U the supply voltage Vsupply of the supply converter DC/DC can be applied with a positive or negative polarity to the series circuit composed of the primary winding of the ignition coil ZS and the switching element IGBT as well as, if appropriate, the resistor R3. For this purpose, the changeover switch U can be controlled by means of a control signal U_Control which is generated by the control circuit Control.

In some embodiments, at the start of an ignition process, thus when the ignition coil is charged, the supply voltage Vsupply is applied with a negative polarity, with the result that the positive potential of the supply voltage Vsupply is applied to the ignition hook of the spark plug ZK and is therefore at the vehicle ground potential. As a result, the breakdown takes place at a relatively low breakdown voltage.

After the breakdown, which is detected by the control circuit Control by evaluation of the voltage U_Prim fed to it and the currents I_Prim and I_Sec through the windings of the ignition coil ZS, the polarity can be reversed by means of the control signal U_Control, with the result that a better inflammation capability of the mixture in the combustion chamber becomes possible.

Figure 3:
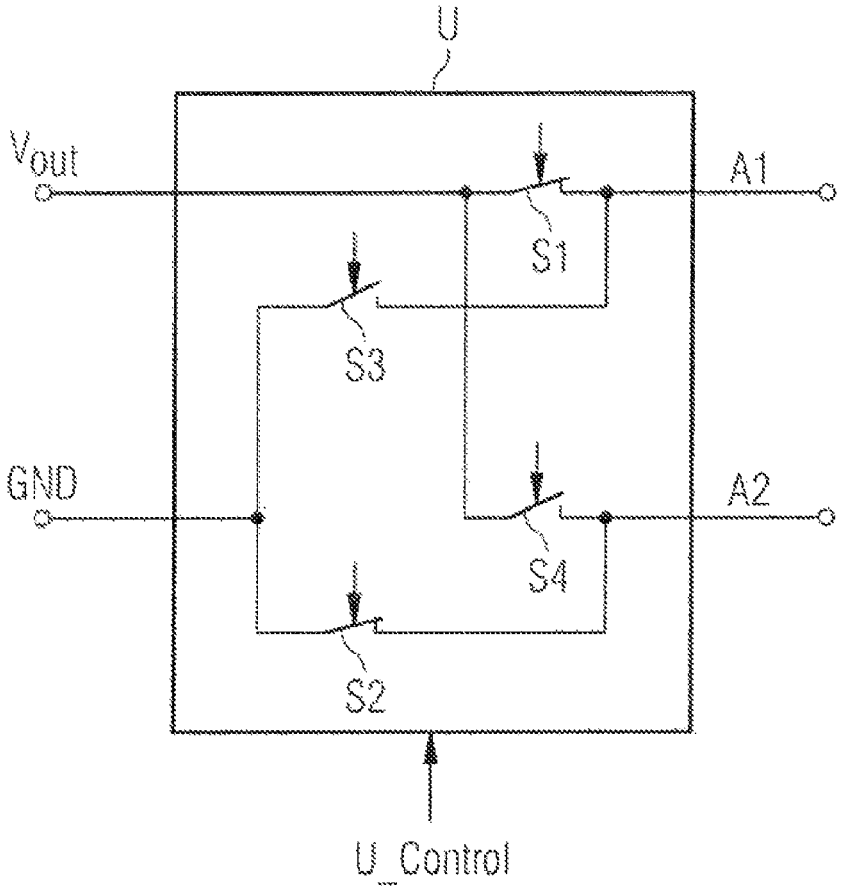
FIG. 3 shows a basic illustration of a changeover switch.

An exemplary embodiment of a changeover switch U is illustrated in FIG. 3. Said switch is formed, in particular, with four switches S1 to S4 by means of which the supply voltage Vsupply and the ground potential GND can be connected either to a first output A1 or a second output A2 by corresponding actuation on the basis of the control signal U_Control. For this purpose, in the exemplary embodiment the input for the positive supply potential Vsupply is connected to the first output A1 via a first switch S1, and to the second output A2 via a fourth switch S4. The input for the reference potential GND of the supply voltage Vsupply is correspondingly connected via a third switch S3 to the first output A1, and via a second switch S2 to the second output A2.

Figure 4:
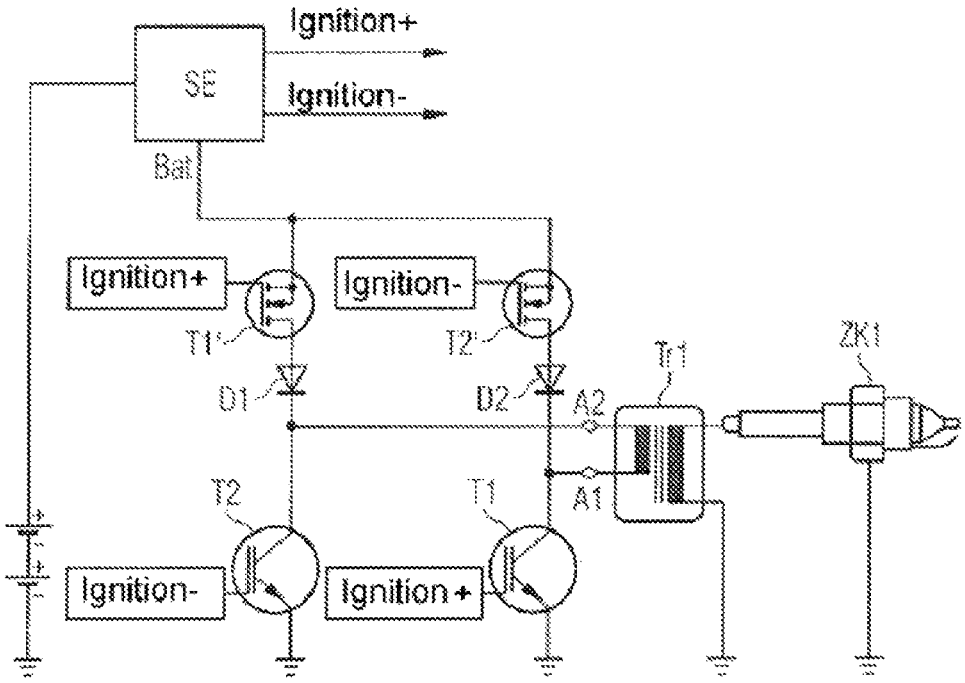
FIG. 4 shows a second embodiment variant of an ignition device according to one embodiment.

A second implementation for reversing the polarity of the primary voltage is to use a bridge arrangement according to FIG. 4.

In said figure, an ignition transformer Tr1, which usually has an iron core, is connected on the secondary side to ground and to the center electrode of a spark plug ZK1. The external electrode of the spark plug is connected to ground. The transmission ratio of the primary number of windings with respect to the secondary number of windings of the ignition transformer Zr1 is typically 1:70 to 1:100.

A first terminal A1 of the primary winding of the ignition transformer Tr1 is connected via a first controllable switching element, embodied as a transistor T1, to reference potential—the ground connection in the example—and via a second switch T2', likewise embodied as a transistor, of a changeover switch T1', T2' to the supply voltage Bat. A second terminal A2 of the primary winding of the ignition transformer Tr1 is likewise connected to the reference potential via a second controllable switching element embodied as a transistor T2, and to the supply voltage Bat via a first switch T1', likewise embodied as a transistor, of the changeover switch.

Since the power transistors which are generally used for such circuits have inverse diodes, diodes D1 and D2 are connected in series with the switches T1' and T2' with polarity such that in the case of deactivated switches current cannot flow back into the supply voltage source from the primary winding of the ignition transformer Tr1. Alternatively, the diodes could also be arranged between the terminals A1, A2 of the primary winding of the ignition transformer Tr1 and the controllable switching elements T1, T2.

The supply voltage Bat can be acquired, for example, from the battery voltage of the motor vehicle battery by means of a DC/DC converter.

In order to charge the ignition transformer Tr1 during operation with a positive center electrode of the spark plug ZK1, the transistors T1 and T1' are switched on simultaneously by a control unit SE using a control signal ignition+, with the result that a flow of current to ground builds up from the supply voltage Bat, likewise made available by the control unit SE, via the first transistor T1' of the changeover switch, the diode D1, the primary winding and the first switching element T1. If the first switching element T1 is then switched off, the voltage at its collector firstly rises to the Zener voltage, and in this context the diode D2 prevents an undesired current path via the inverse diode of the second transistor T2' of the changeover switch to the supply voltage source Bat. The second controllable switching element T2 and the second transistor T2' of the changeover switch firstly remain switched off.

For the purpose of operation with a negative center electrode, the transistors T2 and T2' are now actuated by means of the ignition− control signal by the control unit SE, with the result that a current path is now produced to ground from the supply voltage source Bat via the second transistor T2' of the changeover switch U, the diode D2, the primary winding and the second switching element T2. Since the current now flows in the reverse direction through the primary winding, the polarities of the current and voltage are reversed on the secondary side of the ignition transformer TR1. The first controllable switching element T1 and the first transistor T1' of the changeover switch remain switched off here.

Figure 5:
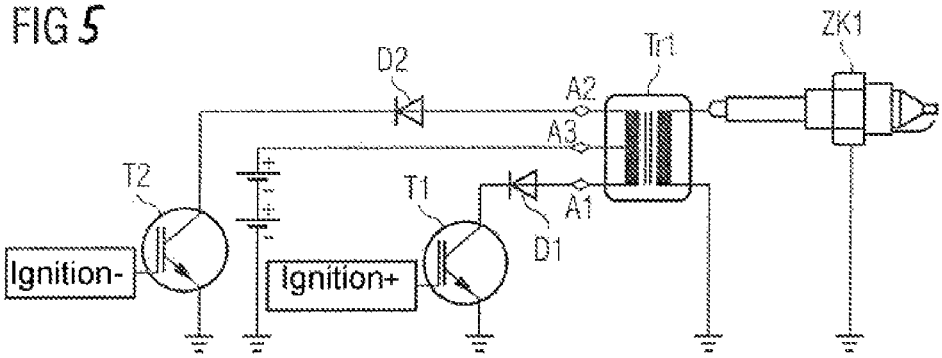
FIG. 5 shows a third embodiment variant of an ignition device according to one embodiment.

A further implementation possibility, according to FIG. 5, is to provide the primary winding of the ignition transformer Tr1 with a center tap A3 which is then connected to the supply voltage Bat. Each end of the primary winding can be connected to ground here, as in the implementation according to FIG. 4, with a separate controllable switching element T1, T2.

For operation with a positive center electrode, the first switching element T1 is actuated by means of an ignition+ signal. The current path which is produced in this context is from the supply voltage Bat, which can likewise be made available by the control unit SE, as in FIG. 4, via the lower part of the primary winding, through the diode D1 and the first switching element embodied as a transistor T1 to ground. The diode T2 prevents, when the transistor T1 switches off, an undesired current path through the second switching element which is likewise embodied as a transistor T2 to ground.

For operation with the negative center electrode, the second switching element T2 is now actuated by the control unit SE by means of the ignition− signal. The current path which is produced in this context is from the supply voltage Bat to ground via the upper part of the primary winding, through the diode D2 and the second switching element T2. The diode D1 prevents, when the second switching element T2 switches off, an undesired current path to ground through the first switching element T1.

Since the primary current now flows in the opposite direction from before, the polarities of the current and voltage on the secondary side are desirably reversed.

The circuit examples presented serve merely to explain the method and do not constitute a claim to completeness. Of course, other embodiments of the reversal of polarity of the secondary current and voltage are also conceivable.

What is claimed is:

1. An ignition device for an internal combustion engine, comprising:

an ignition coil embodied as a transformer and having a primary winding and a secondary winding, the secondary winding configured to connect to a spark plug, a controllable switching element connected in series with the primary winding of the ignition coil, a control unit connected to the primary winding of the ignition coil and to a control input of the switching element, the control unit comprising:

a voltage converter that provides a supply voltage having a polarity for the ignition coil and which is configured for connection to a motor vehicle on-board power system voltage, a controllable changeover switch configured to selectively change the polarity of the supply voltage applied to a series circuit comprising the primary winding of the ignition coil and the switching element, as a function of a control signal, and a control circuit configured to generate the control signal as a function of a phase of the ignition process.

2. The device as claimed in claim 1, wherein the control unit is configured to apply the supply voltage with a negative polarity at the start of an ignition process, and reversing the polarity after a breakdown voltage is reached.

3. An ignition device for an internal combustion engine, comprising:

an ignition coil comprising a transformer and having a primary winding and a secondary winding, the secondary winding configured for connection to a spark plug, a first controllable switching element for connecting a first terminal of the primary winding of the ignition coil to a reference potential, a second controllable switching element for connecting a second terminal of the primary winding of the ignition coil to the reference potential, a controllable changeover switch configured to selectively change the polarity of a supply voltage to either the first terminal or the second terminal of the primary winding of the ignition coil as a function of control signals, and a control unit connected to control inputs of the first and second switching elements and to the changeover switch and configured for connection to a motor vehicle on-board power system voltage, wherein the control unit is configured to provide the supply voltage for the ignition coil and generate the control signals for the controllable switching elements and the controllable changeover switch as a function of a phase of an ignition process.

4. The device as claimed in claim 3, wherein the controllable changeover switch is configured to apply the supply voltage with a negative polarity at the start of an ignition process, and reversing the polarity after a breakdown voltage is reached.

5. A method for operating an internal combustion engine ignition device having an ignition coil embodied as a transformer, a spark plug connected to a secondary winding of the ignition coil, a controllable switching element connected in series with a primary winding of the ignition coil, and a control unit connected to the primary winding of the ignition coil and to the control input of the switching element, the method comprising:

wherein the control unit providing a supply voltage for the ignition coil, the control unit controlling a switching element to selectively change the polarity of the supply voltage applied to a series circuit composed of the primary winding of the ignition coil and the switching element as a function of a control signal, wherein generating the control signal as a function of a phase of the ignition process.

6. The method as claimed in claim 5, comprising the control unit applying the supply voltage with a negative polarity at the start of an ignition process , and reversing the polarity after a breakdown voltage is reached.

* * * * *